US009301547B2

(12) United States Patent
Liu

(10) Patent No.: US 9,301,547 B2
(45) Date of Patent: Apr. 5, 2016

(54) ELECTRONIC CIGARETTE, ELECTRONIC CIGARETTE SMOKE CAPSULE AND ATOMIZATION DEVICE THEREOF

(75) Inventor: Qiuming Liu, Gang'an Dongguan (CN)

(73) Assignee: HUIZHOU KIMREE TECHNOLOGY CO., LTD. SHENZHEN BRANCH, Shenzhen (CN)

( * ) Notice: Subject to any disclaimer, the term of this patent is extended or adjusted under 35 U.S.C. 154(b) by 961 days.

(21) Appl. No.: 13/517,104

(22) PCT Filed: Nov. 19, 2010

(86) PCT No.: PCT/CN2010/078920

§ 371 (c)(1), (2), (4) Date: Jun. 19, 2012

(87) PCT Pub. No.: WO2012/065310

PCT Pub. Date: May 24, 2012

(65) Prior Publication Data

US 2012/0260927 A1 Oct. 18, 2012

(51) Int. Cl.
*A24F 47/00* (2006.01)

(52) U.S. Cl.
CPC ..... *A24F 47/008* (2013.01)

(58) Field of Classification Search
CPC . A24F 47/008; A61M 15/0003; A61M 15/06; A61M 11/042; A61M 11/00
USPC ..... 131/329
See application file for complete search history.

(56) References Cited

U.S. PATENT DOCUMENTS 5,060,671 A * 10/1991 Counts ..... A24F 47/008 128/202.21
5,093,894 A * 3/1992 Deevi ..... A24F 47/008 392/390
5,095,921 A * 3/1992 Losee ..... A24F 47/008 128/200.19
5,144,962 A * 9/1992 Counts ..... A24F 47/008 128/200.14
5,179,966 A * 1/1993 Losee ..... A24F 47/008 128/202.21
5,224,498 A * 7/1993 Deevi ..... A24F 47/008 128/202.21
5,249,586 A * 10/1993 Morgan ..... A24F 47/008 128/200.14
5,269,327 A * 12/1993 Counts ..... A24F 47/008 128/200.14
5,322,075 A * 6/1994 Deevi ..... H05B 3/44 131/194
5,353,813 A * 10/1994 Deevi ..... A24F 47/008 131/194
5,408,574 A * 4/1995 Deevi ..... A24F 47/008 128/202.21
5,505,214 A * 4/1996 Collins ..... A24F 47/008 128/202.21

(Continued)

FOREIGN PATENT DOCUMENTS

CN 201127293 Y 10/2008
CN 201341435 Y 11/2009

OTHER PUBLICATIONS

International Search Report for corresponding PCT/CN2010/078920 dated Jul. 14, 2011.

*Primary Examiner* — Jason L Lazorcik
(74) *Attorney, Agent, or Firm* — Steptoe & Johnson LLP

(57) ABSTRACT

The present invention relates to an electronic cigarette, an electronic cigarette smoke capsule and an atomization device thereof, utilizing more than one heating element. The heating elements are further provided on the same or different smoke output channels and further are connected in parallel. This kind of disposable electronic cigarette, electronic cigarette smoke capsule and the atomization device thereof not only can improve the atomization ability and the product reliability by times, but also can make the atomized tar particles finer.

5 Claims, 4 Drawing Sheets

(56) References Cited

U.S. PATENT DOCUMENTS 5,708,258 A 1/1998 Counts et al.
5,743,251 A * 4/1998 Howell ..... A61M 11/041 128/200.14
5,894,841 A * 4/1999 Voges ..... A24F 47/008 128/200.14
6,234,167 B1 * 5/2001 Cox ..... A61M 15/0065 128/200.14
6,501,052 B2 * 12/2002 Cox et al. ..... 219/486
6,568,390 B2 * 5/2003 Nichols ..... A61M 15/00 128/200.14
7,513,781 B2 * 4/2009 Galauner ..... A61M 11/041 439/509
7,540,286 B2 * 6/2009 Cross ..... A61M 15/0045 128/203.26
7,726,320 B2 6/2010 Robinson et al.
2002/0079309 A1 * 6/2002 Cox ..... A61M 11/041 219/486
2003/0106552 A1 * 6/2003 Sprinkel, Jr. ..... A61M 11/041 128/203.16
2004/0016427 A1 * 1/2004 Byron ..... A61M 11/041 128/200.14
2006/0054165 A1 * 3/2006 Hughes ..... A61M 15/009 128/200.14
2007/0068523 A1 * 3/2007 Fishman ..... A61M 16/0051 128/203.12
2011/0011396 A1 * 1/2011 Fang ..... A61M 15/06 128/202.21
2011/0303231 A1 * 12/2011 Li ..... A24F 47/008 131/329
2012/0048266 A1 * 3/2012 Alelov ..... A61M 11/005 128/202.21
2013/0192623 A1 * 8/2013 Tucker ..... H01C 17/00 131/329
2013/0228191 A1 * 9/2013 Newton ..... A24F 47/008 131/329
2014/0000638 A1 * 1/2014 Sebastian ..... A24F 47/008 131/328
2014/0060556 A1 * 3/2014 Liu ..... A24F 47/008 131/329
2014/0157583 A1 * 6/2014 Ward ..... H05B 3/00 29/611
2014/0190503 A1 * 7/2014 Li ..... A61M 15/06 131/329
2014/0209105 A1 * 7/2014 Sears ..... F22B 1/28 131/328
2014/0261488 A1 * 9/2014 Tucker ..... A24F 47/008 131/328
2014/0366898 A1 * 12/2014 Monsees ..... A24F 47/008 131/329
2015/0059787 A1 * 3/2015 Qiu ..... H05B 3/14 131/329
2015/0083147 A1 * 3/2015 Schiff ..... A24F 47/008 131/329
2015/0164145 A1 * 6/2015 Zhou ..... A24D 1/002 131/329
2015/0196059 A1 * 7/2015 Liu ..... H05B 3/06 131/329
2015/0245669 A1 * 9/2015 Cadieux ..... H05B 6/108 131/329

* cited by examiner

ELECTRONIC CIGARETTE, ELECTRONIC CIGARETTE SMOKE CAPSULE AND ATOMIZATION DEVICE THEREOF

CLAIM FOR PRIORITY

This application claims priority under 35 USC 371 to International Application No. PCT/CN2010/078920, filed on Nov. 19, 2010, which is hereby incorporated by reference in its entirety.

FIELD OF THE INVENTION

The present invention relates to an electronic cigarette, specifically relates to an atomization device that can be applied to a disposable smoke capsule electronic cigarette and a disposable electronic cigarette.

BACKGROUND OF THE INVENTION

Electronic cigarette is a cigarette electronic simulation product, mainly comprising a battery, a switch, a heating element for atomizing tar, a luminescent light for simulating glowing effect. On the market, there are mainly four kinds of electronic cigarettes: a disposable electronic cigarette, a disposable electronic cigarette smoke capsule, a reusable ordinary electronic cigarette and an ordinary electronic cigarette smoke capsule. Take the ordinary electronic cigarette for example, as shown in FIG. 1, the atomization device, comprising a tar guiding fiber and a heating wire which are respectively connected to a tar-storage material and a battery, has only one set of atomization component (the heating wire and the tar guiding fiber). But this kind of electronic cigarette/electronic cigarette smoke capsule with only one set of the atomization component has the problems as followed.

A. Once the set of the atomization component stops working, the whole electronic cigarette couldn't be used; as a result, the workload of the after-sale service increases.

B. The ability to atomize tar is so limited that it's hard to afford a large amount of cigarette smoke.

DISCLOSURE OF THE INVENTION

Technical Problems

The purpose of the present invention is to overcome the defects in the prior art, providing a disposable electronic cigarette, an electronic cigarette smoke capsule and its atomization device which can decrease the warranty workload while increase the smoke output amount.

The Technical Solution

The purpose of the present invention can be achieved by utilizing the three means as followed.

(1) The electronic cigarette atomization device comprises more than one heating element and their circuit loop.

It could also be further achieved by utilizing the following means.

The more than one heating element is provided at different places of the same smoke output channel respectively.

The more than one heating element is provided in different smoke output channels respectively, which can be converged to the sole hole on the cigarette holder or correspond to several holes respectively.

The more than one heating elements are connected in parallel preferably, but in particular cases, they can also be connected in series.

The more than one heating element compromises but not limited to one or more of a resistance wire, a thermal sensitive ceramic or a silicon carbide rod.

The atomization device also comprises a tar guiding fiber that passes through the inner of the spiral resistance wire or a tar guiding fiber provided on the surface of the flat heating element as well as connecting to the tar storage.

(2) The electronic cigarette smoke capsule utilizing the atomization device mentioned in (1), comprises a smoke capsule shell, a hollow tubular bracket, a tar storage between them, and more than one heating element that is provided on the smoke output channel corresponding to the hollow tubular bracket.

It could also be further achieved by utilizing the following means.

There is only one hollow tubular bracket and one smoke output channel corresponding thereto. And the more than one heating elements are provided at different places of the smoke output channel respectively.

There are more than one hollow tubular brackets and more than one smoke output channels corresponding thereto. And the more than one heating elements are provided in different smoke output channels respectively.

The more than one heating elements are connected in parallel preferably, but in particular cases, they can also be connected in series.

The hollow tubular bracket comprises an upper and a lower hollow tubular bracket which two are coaxial and between which is provided the heating element that is arranged obliquely/horizontally.

The hollow tubular bracket is an integral hollow tubular bracket and the heating element passes through the integral hollow tubular bracket.

The hollow tubular bracket can either be a round pipe with diameter larger than or equal to 3 mm; or have a cross section of ellipse, square, polygon or quincunx with a dimension larger than 7 $mm^2$.

The electronic cigarette smoke capsule is a disposable electronic cigarette smoke capsule or a reusable electronic cigarette smoke capsule.

(3) The electronic cigarette utilizing the atomization device mentioned in (1), comprises more than one heating element and a battery electrically connected thereto.

It could also be further achieved by utilizing the following means:

The more than one heating elements are all respectively provided at different places in the same smoke output channel.

The more than one heating elements are respectively provided in different smoke output channels, which can be converged to the sole hole on the cigarette holder or correspond to several holes respectively.

The heating elements are connected in parallel preferably, but in particular cases, they can also be connected in series.

The electronic cigarette is a disposable electronic cigarette, a disposable smoke capsule electronic cigarette, a reusable electronic cigarette, an electronic cig cigarette or an electronic tobacco pipe.

Beneficial Effects

Compared with the prior art, the present invention has the beneficial effects as followed.

A. It comprises several atomization components which have improved the atomizing ability of the product and provided several times as much amount of atomized smoke;

B. It comprises several atomization components which have improved the reliability of the product (even if one of the atomization components stops working, others can continue to work);

C. The heating elements arranged on the same smoke channel implement atomization layer by layer, making the atomized liquid particles finer.

THE PREFERRED EMBODIMENTS OF THE INVENTION

Figure 1:
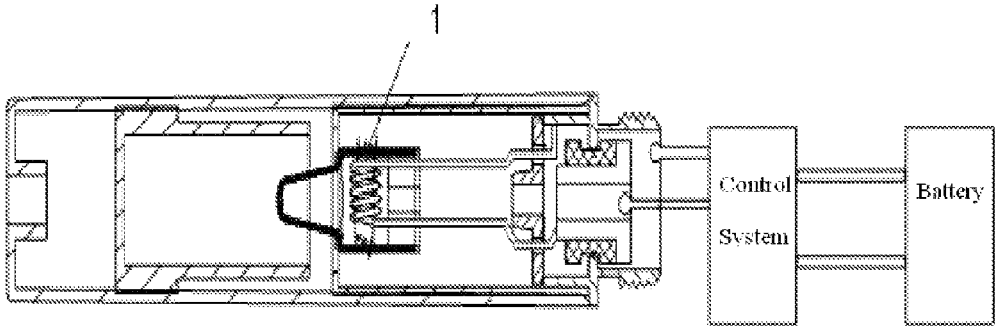
FIG. 1 shows a structural representation of a traditional ordinary electronic cigarette.
Figure 2:
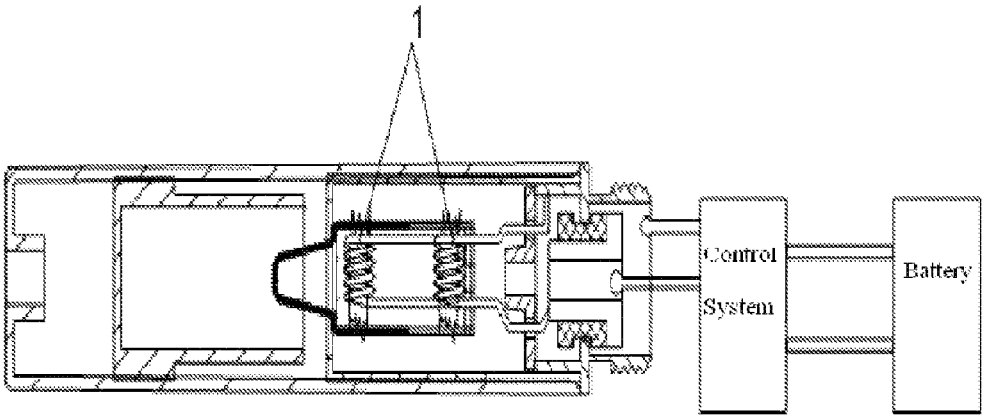
FIG. 2 shows a structural representation of an ordinary electronic cigarette with two atomization devices in the present invention.

As shown in FIG. 2, on the basis of one traditional set of atomization component, the atomization device of the ordinary electronic cigarette is added with another set of atomization component comprising a heating resistance wire 1 and a tar guiding fiber.

Figure 3:
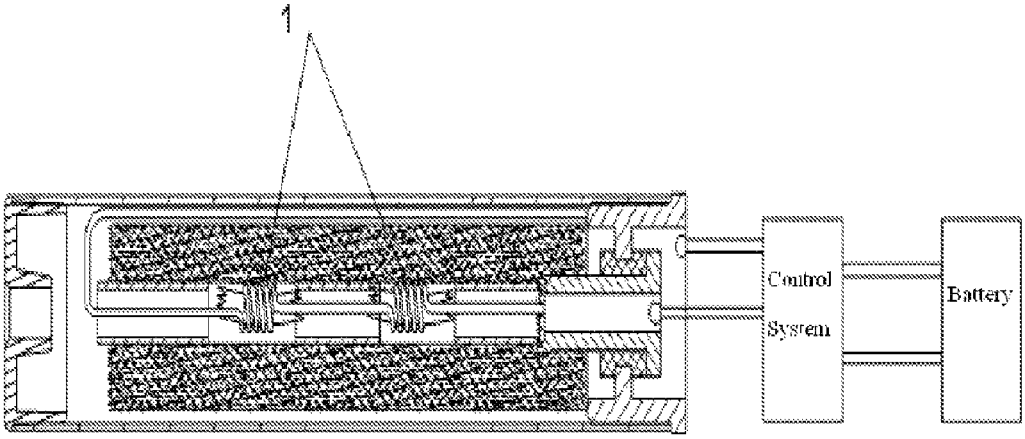
FIG. 3 shows a structural representation of a disposable electronic cigarette with two atomization devices in the present invention.

As shown in FIG. 3, on the basis of one traditional set of atomization component, the atomization device of the disposable electronic cigarette is added another set of atomization component on the same smoke output channel consisted of several sections of hollow tubular brackets; wherein, the another set of atomization component comprises a heating resistance wire and a tar guiding fiber. The heating resistance wire 1 is vertically arranged and the hollow tubular bracket is divided into three sections between two of which is provided the heating resistance wire.

Figure 4:
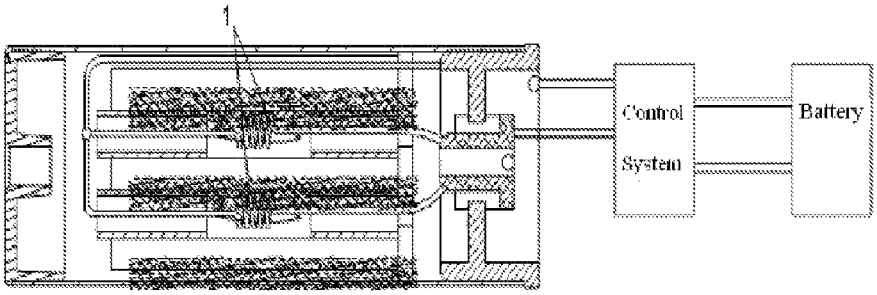
FIG. 4 shows a structural representation of a disposable electronic cigarette with two tubules and two atomization devices in the present invention.

As shown in FIG. 4, on the basis of one traditional set of atomization component, the atomization device of the disposable electronic cigarette is added with another smoke output channel consisted of two sections of hollow tubular brackets and with another set of atomization component thereon; wherein, the the another set of atomization component comprises a heating resistance wire and a tar guiding fiber. The heating resistance wires 1 are vertically arranged between the two sections of their respective hollow tubular bracket.

Figure 5:
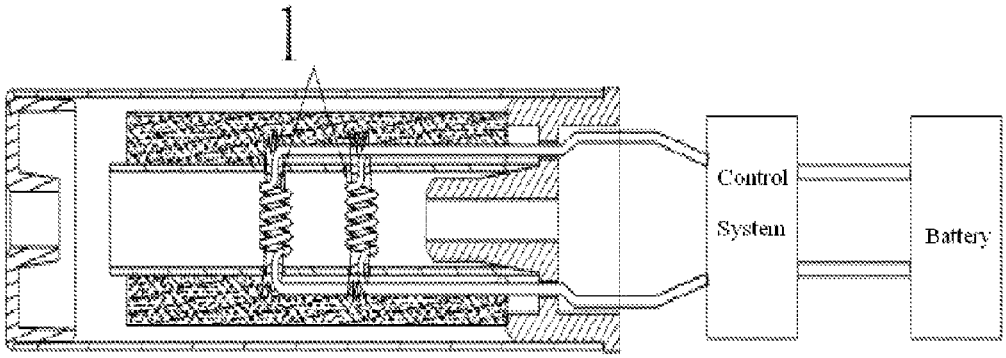
FIG. 5 shows a structural representation of a horizontally arranged disposable electronic cigarette with two atomization devices in the present invention.

As shown in FIG. 5, on the basis of one traditional set of atomization component, the atomization device of the disposable electronic cigarette is added another set of atomization component in the same smoke output channel consisted of a hollow tubular bracket comprising a heating resistance wire and a tar guiding fiber. The heating resistance wire 1 is horizontally arranged and the hollow tubular bracket is integral through which the heating resistance wire crosses.

Figure 6:
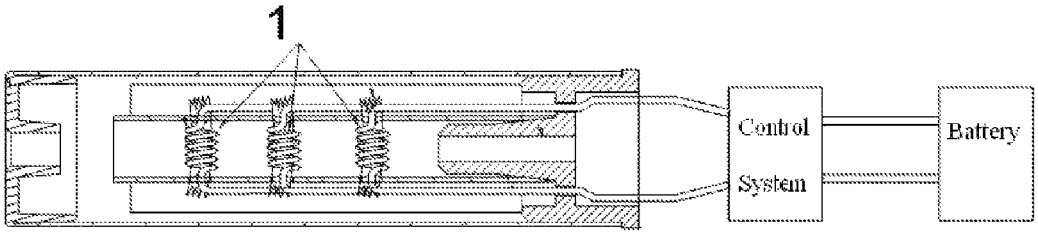
FIG. 6 shows a structural representation of a horizontally arranged disposable electronic cigarette with three atomization devices in the present invention.

As shown in FIG. 6, on the basis of one traditional set of atomization component, the atomization device of the disposable electronic cigarette is added two sets of atomization components in the same smoke output channel consisted of a hollow tubular bracket, comprising a heating resistance wire and a tar guiding fiber respectively. The heating resistance wire 1 is horizontally arranged and the hollow tubular bracket is integral through which the heating resistance wire crosses.

Figure 7:
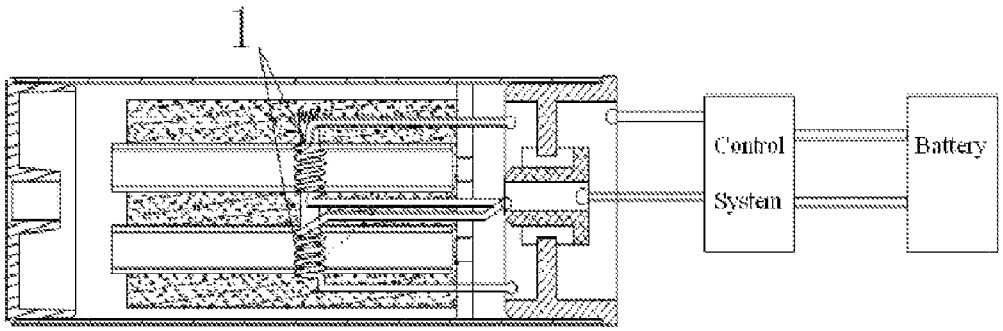
FIG. 7 shows a structural representation of a horizontally arranged disposable electronic cigarette with two tubules and two atomization devices in the present invention.

As shown in FIG. 7, on the basis of one traditional set of atomization component, the atomization device of the disposable electronic cigarette is added another smoke output channel consisted of a hollow tubular bracket and another set of atomization component thereon, comprising a heating resistance wire and a tar guiding fiber. The heating resistance wire is horizontally arranged and the hollow tubular bracket is integral through which the heating resistance wire crosses.

Figure 8:
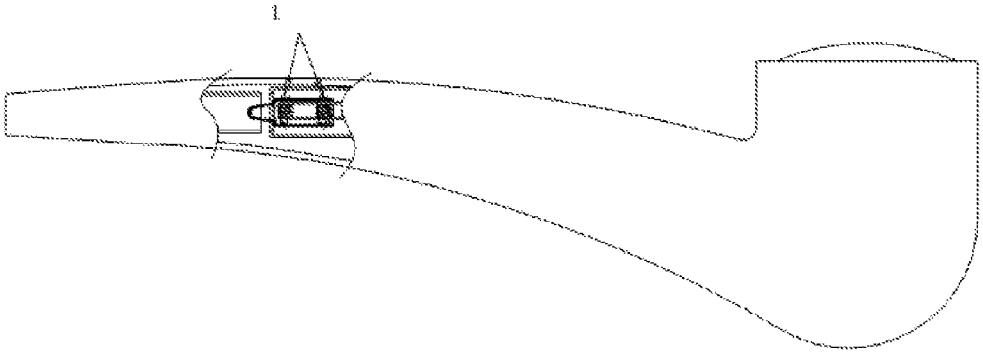
FIG. 8 shows a structural representation of an electronic tobacco pipe with two atomization devices in the present invention.

As shown in FIG. 8, on the basis of one traditional set of atomization device, the atomization device of the electronic tobacco pipe is added another set of atomization component, comprising a heating resistance wire 1 and a tar guiding fiber.

The Implementation of the Invention

The Industrial Applicability

The atomization device of the present invention is applicable to an electronic cigarette or an electronic cigarette smoke capsule, which can improve the atomization ability as well as the product reliability by times, as a result, it makes lots of smokers receive pleasure from non-toxic smoking at low cost.

The invention claimed is:

1. An electronic cigarette atomization device, comprising
- a hollow tubular body,
- a supporting tube coaxially arranged within the hollow tubular body,
- a liquid absorbing media arranged between the hollow tubular and the supporting tube;
- at least two heating elements transversely supported in the supporting tube, and
- a current loop of the heating elements;
- wherein, the supporting tube is configured to be a smoke output channel, the at least two heating elements are spaced in the smoke output channel along a longitudinal axis of the smoke output channel.

2. The atomization device of claim 1, wherein, the at least two heating elements are electrically connected in parallel.

3. An electronic cigarette utilizing the atomization device of claim 1, comprising the atomization device and a battery electrically connected therewith;
- wherein, the atomization device comprises
- a hollow tubular body,
- a supporting tube coaxially arranged within the hollow tubular body,
- a liquid absorbing media between the hollow tubular and the supporting tube;
- at least two heating elements transversely supported in the supporting tube, and
- a current loop of the heating elements; and wherein, the supporting tube is configured to be a smoke output channel, the at least two heating elements are spaced in the smoke output channel along a longitudinal axis of the smoke output channel.

4. The electronic cigarette of claim 3, wherein, the at least two heating elements are electrically connected in parallel.

5. The electronic cigarette of claim 3, wherein, the electronic cigarette is a disposable electronic cigarette, a disposable smoke capsule electronic cigarette, a reusable ordinary electronic cigarette, or an electronic tobacco pipe.

* * * * *